US005492247A

United States Patent [19]

Shu et al.

[11] Patent Number: 5,492,247

[45] Date of Patent: Feb. 20, 1996

[54] AUTOMATIC SOAP DISPENSER

[76] Inventors: Aling Shu, No. 5, Lane 157, Yen Ping South Rd.; Tsang-Chang Hwang, 3F, No. 30, Alley 31, Lane 49 Sec. 4, Chung King N. Rd., both of Taipei; Kuo-Chou Lee, No. 93, Shang-Jen Street, Noan Noan, Keelung City, all of Taiwan

[21] Appl. No.: 253,080

[22] Filed: Jun. 2, 1994

[51] Int. Cl.[6] ..... B67D 5/60

[52] U.S. Cl. ..... 222/63; 222/95; 222/207; 222/214; 74/89.15; 141/351

[58] Field of Search ..... 222/52, 63, 95, 222/181, 103, 207, 214, 333; 141/98, 351; 74/89.15; 251/129.04; 417/412, 413.1

[56] References Cited

U.S. PATENT DOCUMENTS

| | | | |
|---|---|---|---|
| 4,256,242 | 3/1981 | Christine | 202/207 |
| 4,722,372 | 2/1988 | Hoffman et al. | 222/52 |
| 4,946,070 | 8/1990 | Albert et al. | 222/52 |
| 4,951,915 | 8/1990 | Piao | 251/129.04 |
| 5,105,992 | 4/1992 | Fender et al. | 222/185 |
| 5,215,218 | 6/1993 | Choi | 222/63 |

*Primary Examiner*—Andres Kashnikow
*Assistant Examiner*—Lisa Ann Douglas
*Attorney, Agent, or Firm*—Bacon & Thomas

[57] ABSTRACT

An automatic soap dispenser having an infrared sensing device and associated circuitry to trigger a driver device into operation. The dynamic power of the device is generated from a motor, through a speed reducing gear to deliver a low speed, high torque driving power to a toothed piece. The toothed piece is driven forward in a direction perpendicular to the soap feeding tube of the soap storage bag, allowing liquid soap in the feeding tube to be squeezed and dispensed for hands cleaning. When the squeezing operation is accomplished, the resiliency of the feeding tube pushes the toothed piece back to its original position and is ready for the next soap dispensing.

3 Claims, 6 Drawing Sheets

AUTOMATIC SOAP DISPENSER

BACKGROUND OF THE INVENTION (a) Field of the Invention

The present invention relates to an automatic soap dispenser, particularly to a liquid soap dispenser with an infrared sensor to sense and control the dispensing of liquid soap.

(b) Description of the Prior Art

A conventional soap dispenser consists of a housing which holds a package of liquid soap. The package of soap usually comes with a feeding tube, which is placed on a holding base. A user normally presses a cover or a handle to squeeze a small amount of liquid soap for cleaning. A more advanced type of automatic soap dispenser uses a solenoid valve to control a moving plate, and electromagnetic force is generated to push and squeeze the soap feeding tube to dispense the liquid soap. In addition, infrared sensing is also applied to sense the hands and a sector gear is driven to squeeze the soap feeding tube to dispense the liquid soap for use.

SUMMARY OF THE INVENTION

The main object according to the present invention is to provide an automatic soap dispenser in which an infrared sensing device, together with a driver device is used to drive an elongated toothed piece in a forward direction, allowing a pressed member provided in the forward section of the toothed piece to squeeze a soap feeding tube so that liquid soap can be dispensed for cleaning. By this design, the movement of the toothed piece is perpendicular to the soap feeding tube and, thus a fixed amount of liquid soap can be dispensed to give a precise and stable operation.

Another object according to the present invention is to provide an automatic soap dispenser in which the infrared sensing device can be deactivated when the housing of the structure is opened. A post provided in the housing is used to deactivate a micro switch of the infrared sensing device, thus it is a convenient feature to open the housing to replace the liquid soap bag or the battery pack.

A further object according to the present invention is to provide an automatic soap dispenser in which the battery pack is stored in an enclosed chamber and its orientation is perpendicular to the soap feeding tube, therefore, the liquid soap can be prevented from contacting the battery pack and decrease the life of the battery pack.

Still another object according to the present invention is to provide an automatic soap dispenser in which the sensing and the driver devices are enclosed in a chamber which is isolated from the soap bag and the soap feeding tube. Thus the automatic soap dispenser can be prevented from being exposed to a corrosive environment and a trouble-free operation can be assured.

The automatic soap dispenser according to the present invention differs from the prior art in that the pressed member will only be driven to squeeze once when the sensing device is triggered. On the other hand, the conventional soap dispenser continues to dispense the liquid soap once it is triggered. Thus the present invention can provide a savings of liquid soap usage.

BRIEF DESCRIPTION OF THE DRAWINGS

The invention will be more fully understood from the following detailed description thereof, taken in conjunction with the accompanying drawings, in which.

DETAILED DESCRIPTION OF THE PREFERRED EMBODIMENT

Figure 1:
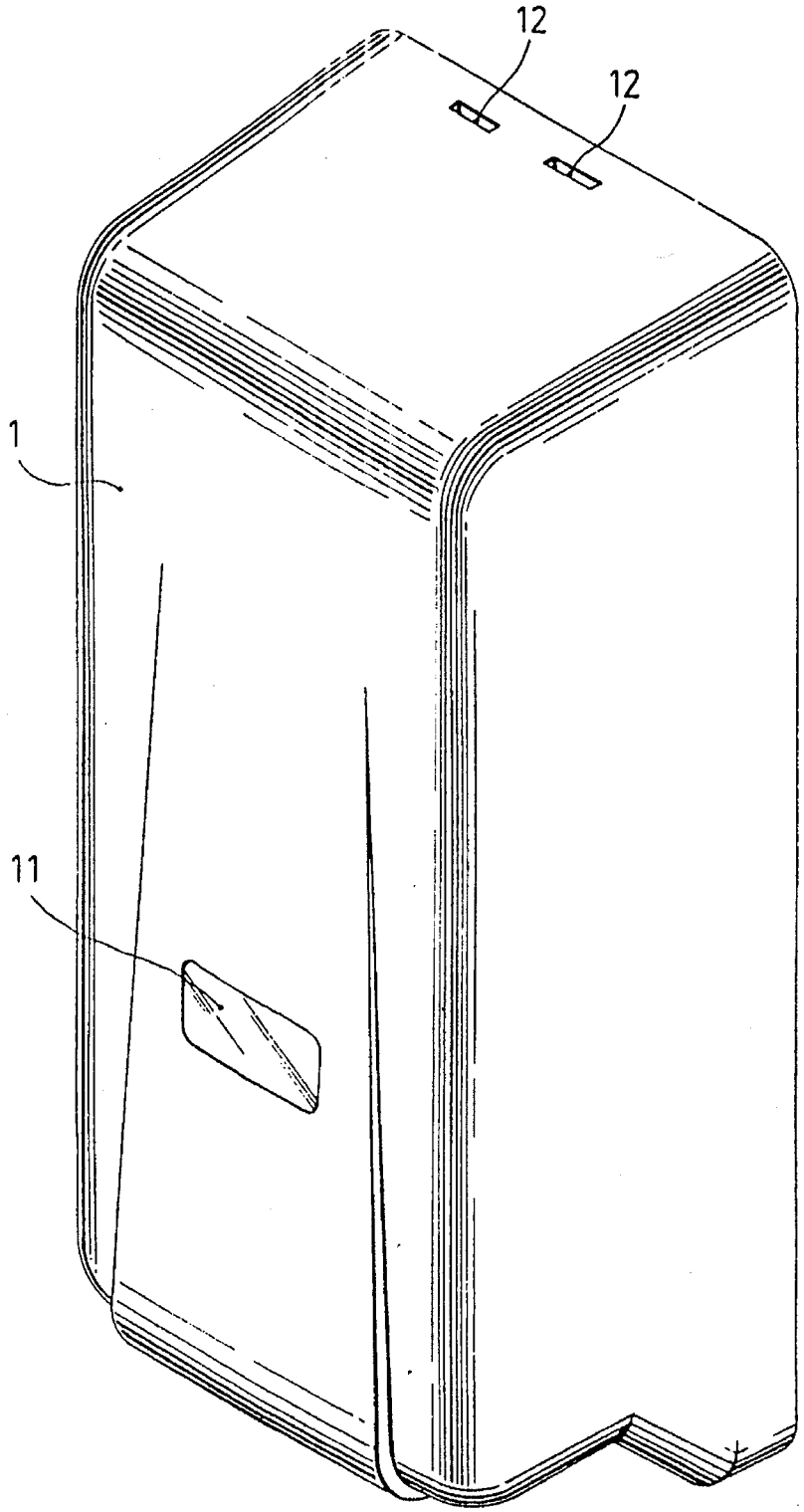
FIG. 1 is a perspective view of the automatic soap dispenser according to the present invention.
Figure 2:
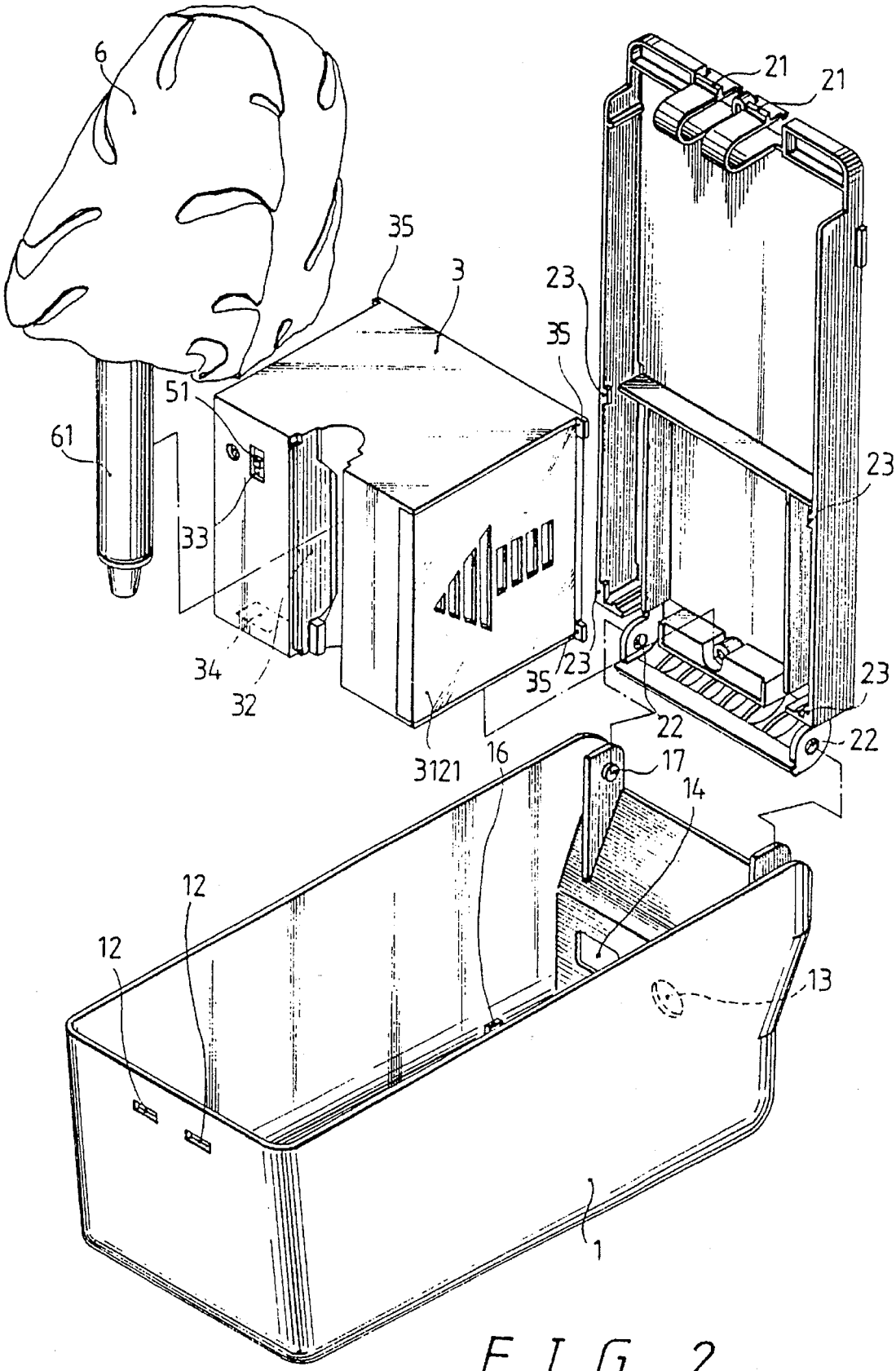
FIG. 2 is a perspective fragmented view of the present invention.

As shown in FIGS. 1 and 2, the automatic soap dispenser according to the present invention comprises a first housing 1, a base 2, a second housing or holding base 3, a driver device 4 and an infrared sensing device 5. In addition, a soap storage bag 6 is provided and placed on top of the holding base 3 for dispensing liquid soap automatically.

Housing 1 is formed into an appropriate shape for enclosing the components of the soap dispenser. The front of housing 1 is provided with a viewing window 11, and the top of housing 1 is provided with two slots 12. The bottom surface of housing 1 is provided with a guided tube hole 13 and a sensing hole 14. The inner front wall of housing 1 is provided with a blocking plate 15 and a post 16.

The base 2 is a plate corresponding to the opening of housing 1, its top is provided with two latching plates 21 and the two sides of its bottom are respectively provided with a pivotal hole 22, which is used for the pivotal connection between housing 1 and base 2, thereby providing a movable coupling. Latching plates 21 are used as components for opening and closing. In addition, in a selected location of base 2 is provided with a plurality of insertion plates 23 for the insertion and positioning of holding base 3.

Figure 3:
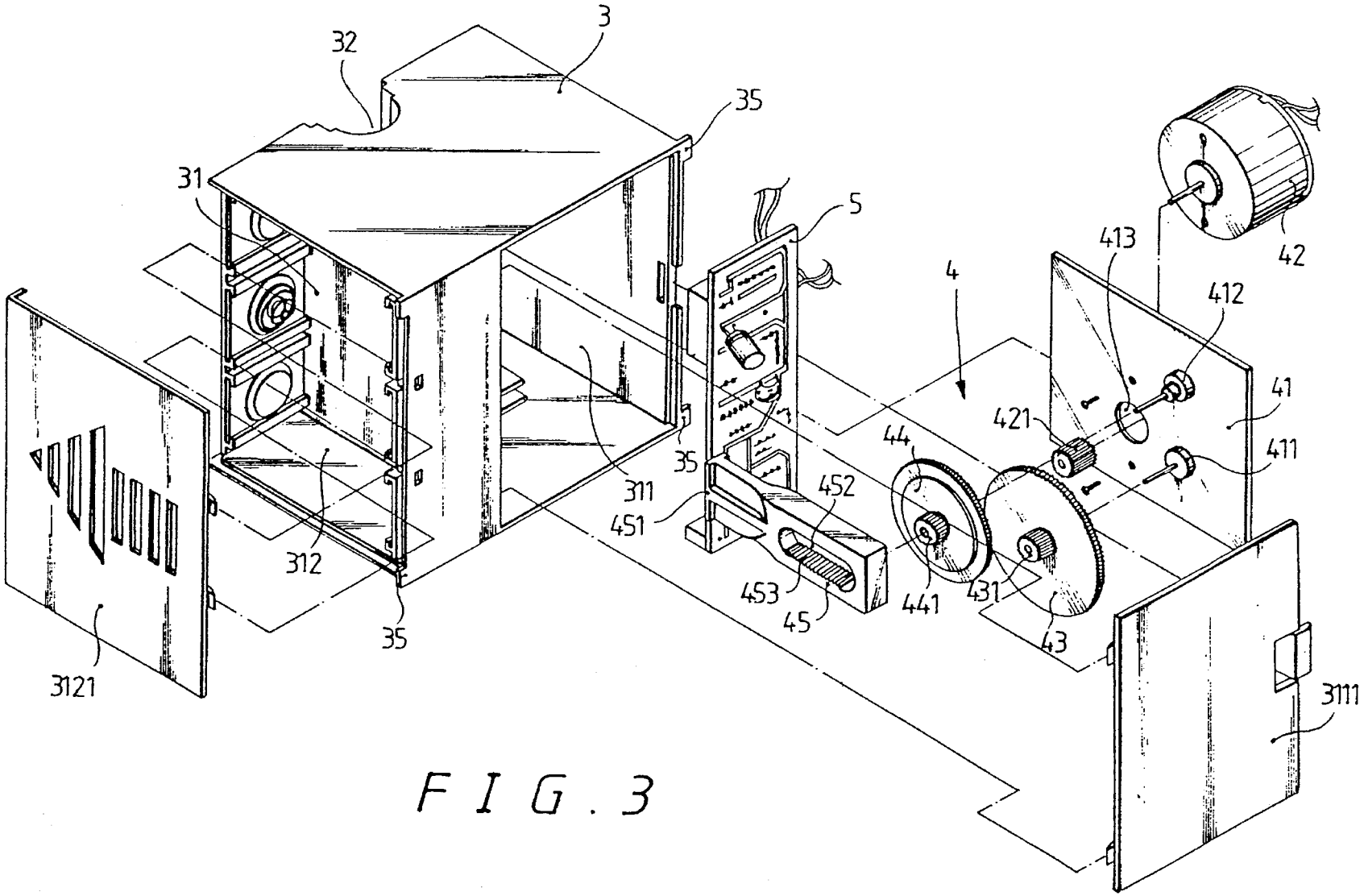
FIG. 3 is a perspective fragmented view of the holding base according to the present invention.
Figure 4:
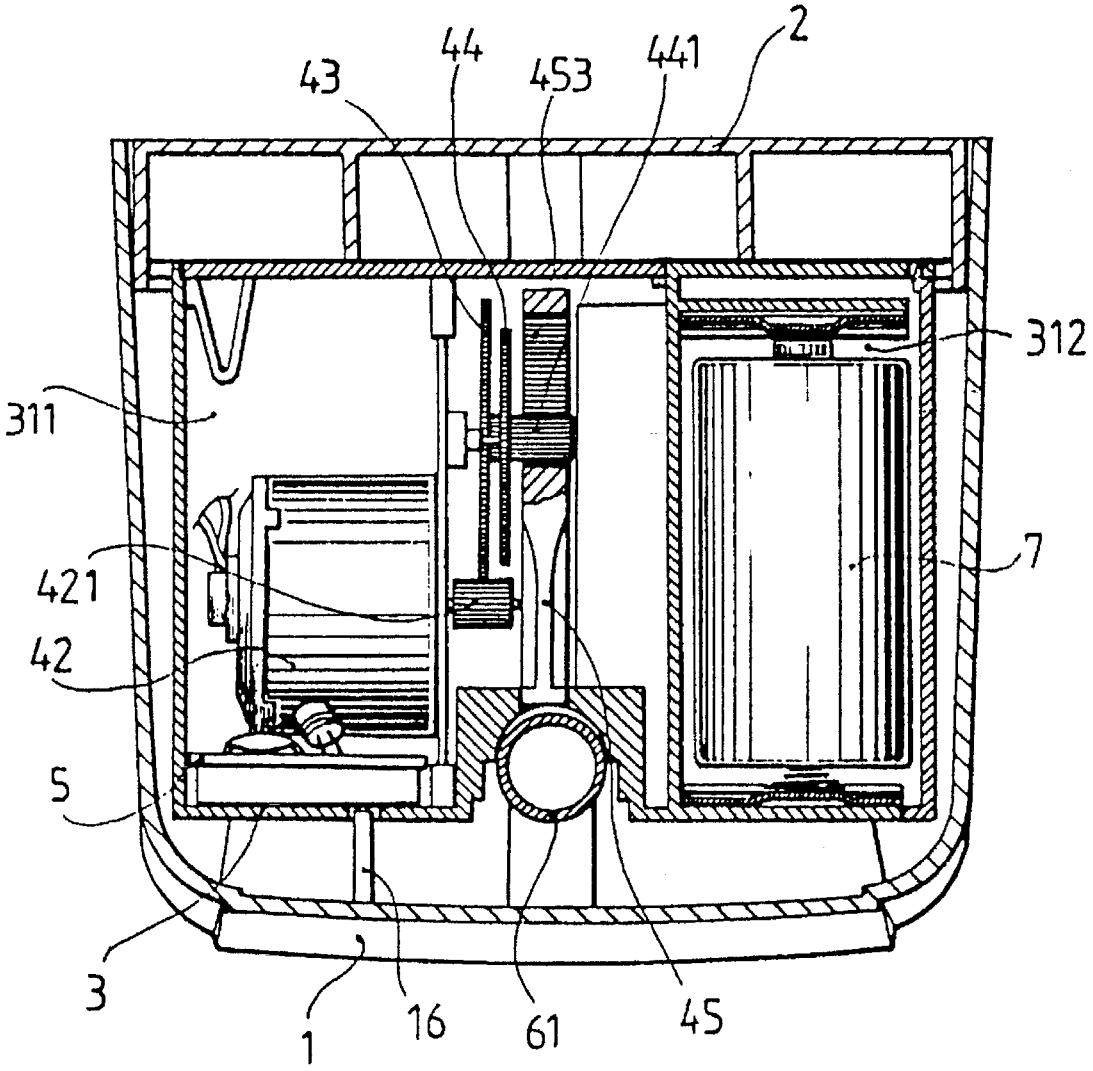
FIG. 4 is a cross sectional view of the holding base assembly according to the present invention.
Figure 5:
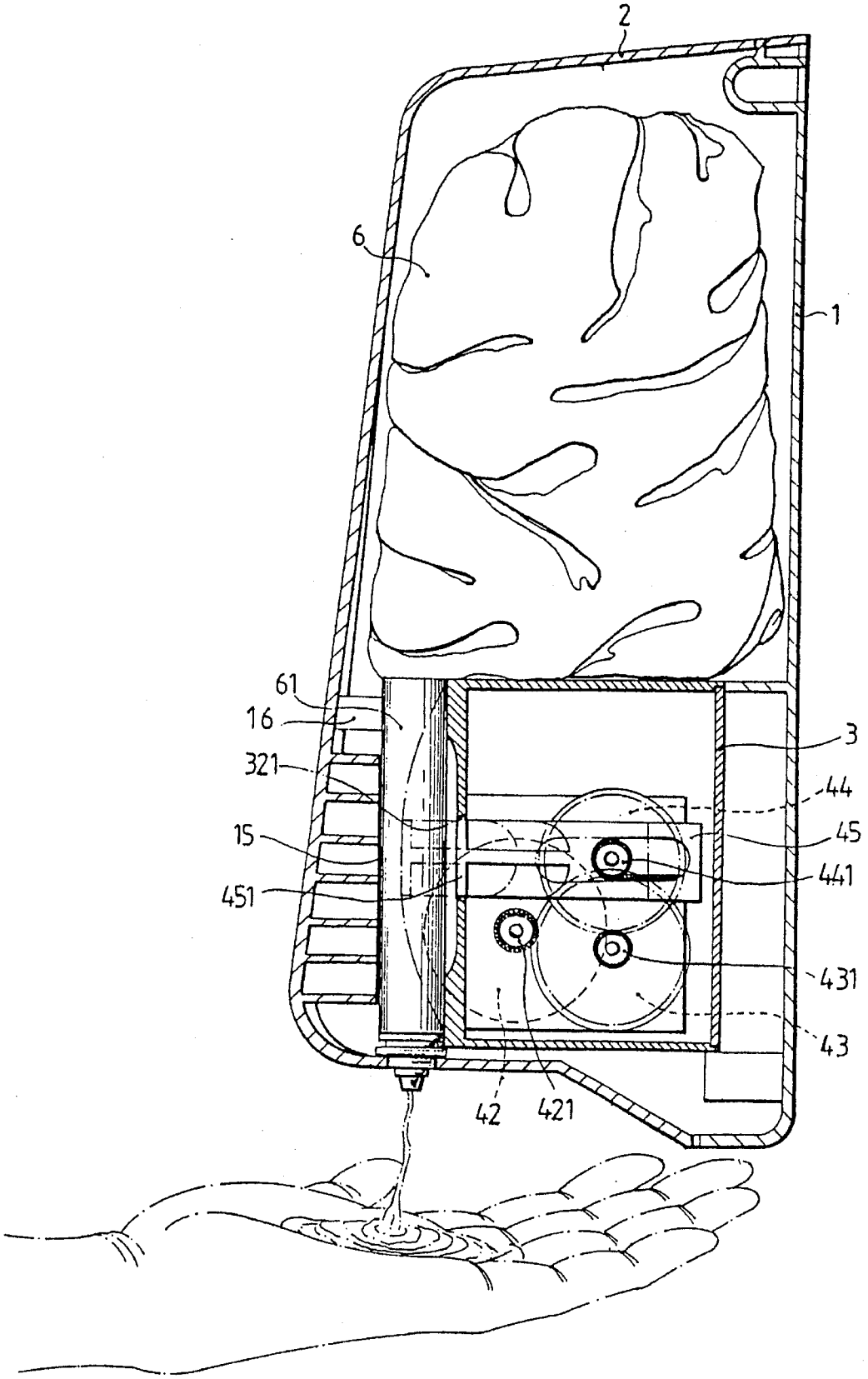
FIG. 5 is a cross sectional view of the automatic soap dispenser assembly according to the present invention.
Figure 6:
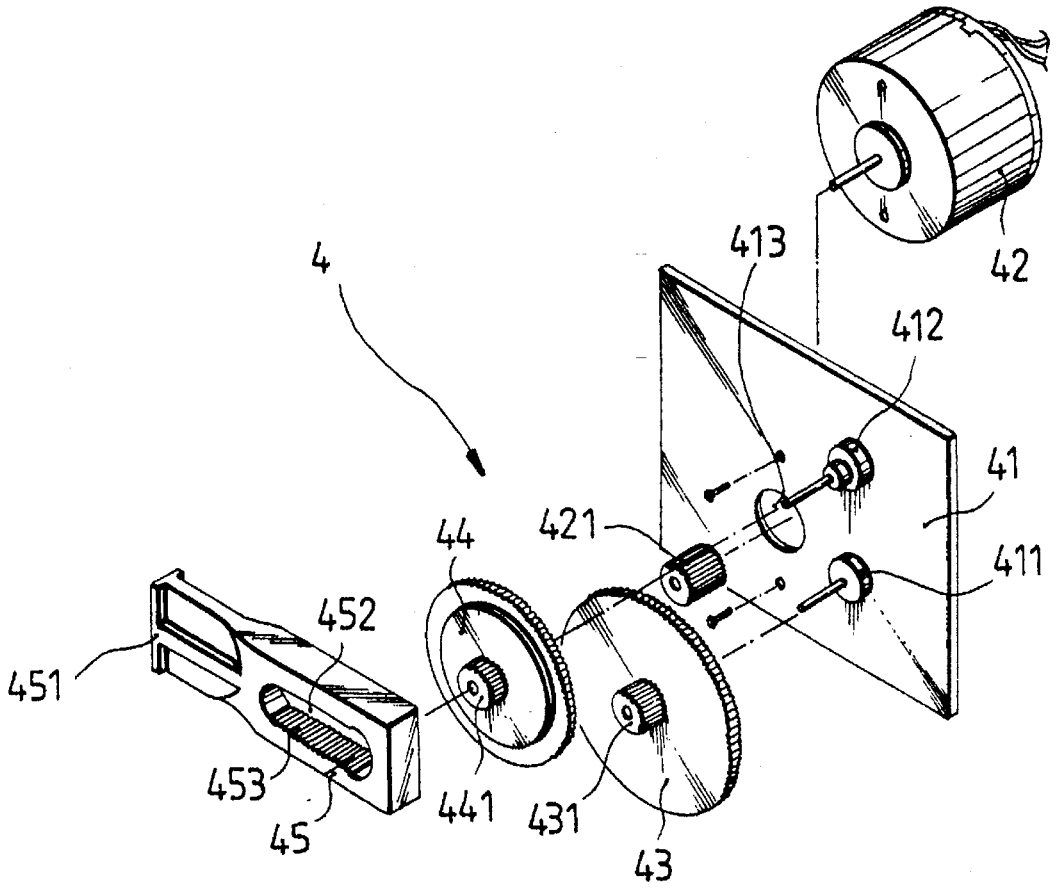
FIG. 6 is an exploded perspective view showing the elements of the driver device.

The holding base 3, as is shown in FIGS. 3 and 4, is formed into the shape of a housing, its interior is provided with a divider wall 31, which divides the holding base 3 into two internal chambers 311 and 312. Internal chamber 311 is provided for the storage of driver device 4 and the infrared sensing device 5. A cover 3111 is provided for opening and closing of the chamber 311. Internal chamber 312 is provided for storage to a battery pack 7, and a cover 3121 is also provided for the access of the chamber 312. The central portion at the front of holding base 3 is formed into a concave guided tube channel 32. The surface of the guide tube channel 32 is provided with a hole 321. One edge at the front surface of holding base 3 is provided with a hole 33, and the bottom of holding base 3 is provided with a sensing hole 34.

The driver device 4 consists of a panel 41, which is provided with two supporting shafts 411 and 412 and a hole 413 for securing the gearing and motor 42 in place. The driver device 4 uses a motor 42 to drive a small gear 421 on the same shaft, and a large gear 43 can then be driven by gear 421. A small gear 431 on the same shaft of the large gear 43 is then used to transmit power to another large gear 44. Another small gear 441 on the same shaft of large gear 44 is used to drive an elongated toothed piece 45. The forward portion of toothed piece 45 is provided with a presser member 451, and the center portion is provided with an elongated hole 452. The wall on the bottom of elongated hole 452 is formed into a toothed section 453, the teeth of which mesh with the teeth of small gear 441. The forward section of toothed piece 45 is extendible through the hole 321 of the guide tube channel 32 of holding base 3, and thus its front surface can be used to press soap feeding tube 61 of the soap storage bag 6.

Infrared sensing device 5 is provided inside the chamber 311 of holding base 3. A micro switch 51 is installed corresponding to the hole 33 provided on the holding base 3, and a detector is provided corresponding to the sensing hole 34 of the holding base 3. When a user's hand is detected, the sensing signal triggers the driver device 4 to dispense soap automatically.

The soap storage bag 6 is used to hold liquid cleaner, one end of bag 6 is provided with the soap feeding tube 61, which is a flexible tube and is placed inside the guided tube channel 32 of the holding base 3.

By the above configuration, housing 1 can be pivotally connected to base 2 by use of pivotal shaft 17 and the pivotal hole 22. In addition, the latching plates 21 provided in base 2 can be retained and secured in the slots 12 of housing 1, and the latching plates 21 are used as a means for opening and closing housing 1. Two lugs 35 provided on both sides of the holding base 3 are used to secure with the insertion plates 23 of base 2, and driver device 4 and infrared sensing device 5 are contained inside chamber 311 of the holding base 3. Soap storage bag 6 is placed on the top surface of holding base 3, and soap feeding tube 61 is placed inside the guide tube channel 32 of the holding base 3. The post 16 provided in the inner wall of housing 1 cooperates with the hole 33 of the holding base 3 to press against the micro switch 51 of the infrared sensing device 5 for activating the automatic soap dispenser When housing is closed. On the other hand, if the housing 1 is opened, then the post 16 is no longer in contact with the micro switch 51, and therefore, the automatic soap dispenser is not activated. When housing 1 and base 2 are closed together, the blocking plate 15 in the inner wall of housing 1 engages the outer surface of the soap feeding tube 61 of the soap storage bag 6, and the bottom of the soap feeding tube 61 is exposed outside the guide-tube hole 13 of housing 1.

The operation of the automatic soap dispenser is described as follows: when a signal is detected by the infrared sensing device 5 of the automatic soap dispenser, motor 42 is triggered to start, and power is transmitted through small gear 421, transmission large gear 43, another small gear 431, large gear 44 to small gear 441. Since the teeth of the small gear 441 mesh, or mate with the teeth 453 of the elongated toothed piece 45, therefore, the toothed piece 45 can be driven at a higher torque in a straightforward direction. Normally, the forward section of the toothed piece 45 is extended through the hole 321 of the guide tube channel 32 of holding base 3, also, the presser member 451 of the toothed piece 45 is urging the outer surface of soap feeding tube 61, and the other outer surface of the feeding tube 61 is supported by the blocking plate 15 of housing 1. Therefore, when the toothed piece 45 is driven to move in a straightforward direction, the presser member 451 provided at one end of the toothed piece presses against the soap feeding tube 61, squeezing the liquid soap therein. When the preset duration of squeezing the feeding tube 61 is reached, the infrared sensing device 5 sends out a signal to stop the driver device. At this time an appropriate amount of liquid soap has been squeezed out and the operation of dispensing is thus completed. Since the soap feeding tube 61 is relatively flexible, therefore, the flexible tube 61 pushes, by resiliency, the toothed piece 45 back to the original position to get ready for the next operation.

In use, a user places his hand underneath the guide tube hole 13 of housing 1, the sensor of the infrared sensing device 5 then senses the hand and outputs a command signal to start the motor. Through the transmission of gearing, the toothed piece is driven to move in a straightforward direction to squeeze the soap feeding tube 61. Thus the liquid soap inside the feeding tube 61 can be dispensed by a preset amount into the hands of the user. After the dispensing of liquid soap, the flexibility and resiliency of the feeding tube 61 pushes the toothed piece 45 back to its original position so as to get ready for the next operation. The movement of the toothed piece 45 can be controlled by an electric circuit. In order to control the forward or backward movement of the toothed piece 45, a timer can be used to cut off the electric circuit or micro switches can be used to control the rotation of the motor.

It is understood that the foregoing description and accompanying illustrations are merely exemplary, and various changes and modifications to the preferred embodiments will be apparent to those skilled in the art. The scope of this invention is defined solely by the appended claims and their equivalents.

What is claimed is:

1. An automatic soap dispenser comprising:

a) a base;

b) a first housing pivotally connected to the base for movement between an open position and a closed position, the first housing defining an enclosed space with the base when in the closed position;

c) latching means for detachably securing the first housing to the base in the closed position;

d) a second housing mounted to the base and disposed within the enclosed space, the second housing including separate first and second chambers, each chamber further including a cover for opening and closing the chamber, a concave guide tube formed in a front wall of the second housing, and a hole formed in the guide tube;

e) a driver device and an infrared sensing device disposed in the first chamber, the driver device including a motor, a gear assembly including a speed reducing gear driven by the motor and an elongate member driven by the gear assembly for reciprocating movement towards and away from the hole in the guide tube, the elongate member including an elongate hole and a toothed section formed on a bottom wall of the elongate hole for engagement by said gear of the gear assembly, and the infrared sensing device for operating the motor upon sensing the presence of a hand below the dispenser;

f) an electric power supply disposed in the second chamber for energizing the motor; and g) a soap storage bag supported on the second housing and disposed within the enclosed space, the storage bag including a downwardly extending feeding tube disposed within the concave guide tube for dispensing soap upon engagement of the tube by the elongate member during the reciprocating movement thereof.

2. The soap dispenser of claim 1 wherein the first housing includes an inner front wall and a blocking plate carried by the inner front wall and for engaging an outer surface of the feeding tube.

3. The soap dispenser of claim 1 wherein the first housing includes an inner front wall, a post mounted on the inner front wall, and the infrared sensing device includes a microswitch engageable by the post when the first housing is in the closed position for activating the infrared sensing device.

* * * * *